US008662845B2

(12) United States Patent
Virkler et al.

(10) Patent No.: US 8,662,845 B2
(45) Date of Patent: Mar. 4, 2014

(54) MULTI-FUNCTION HEAT SHIELD FOR A GAS TURBINE ENGINE

(75) Inventors: Scott D. Virkler, Ellington, CT (US); Jason Arnold, Rocky Hill, CT (US)

(73) Assignee: United Technologies Corporation, Hartford, CT (US)

( * ) Notice: Subject to any disclaimer, the term of this patent is extended or adjusted under 35 U.S.C. 154(b) by 636 days.

(21) Appl. No.: 13/004,231

(22) Filed: Jan. 11, 2011

(65) Prior Publication Data

US 2012/0177495 A1 Jul. 12, 2012

(51) Int. Cl.
*F01D 5/08* (2006.01)
*F01D 5/18* (2006.01)

(52) U.S. Cl.
USPC ..... 416/97 R; 416/96 R; 416/220 R; 416/221; 415/115; 415/116

(58) Field of Classification Search
USPC ..... 416/95, 96 R, 97 R, 96 A, 220 R, 221; 415/115, 116
See application file for complete search history.

(56) References Cited

U.S. PATENT DOCUMENTS

| | | | | |
|---|---|---|---|---|
| 2,623,727 | A * | 12/1952 | McLeod | 416/97 R |
| 2,788,951 | A | 4/1957 | Flint | |
| 2,988,325 | A | 6/1961 | Dawson | |
| 3,031,132 | A | 4/1962 | Davies | |
| 3,982,852 | A | 9/1976 | Andersen et al. | |
| 3,997,962 | A | 12/1976 | Kleitz et al. | |
| 4,004,860 | A | 1/1977 | Gee | |
| 4,019,833 | A | 4/1977 | Gale | |
| 4,127,988 | A | 12/1978 | Becker | |
| 4,480,958 | A | 11/1984 | Schlechtweg | |
| 4,558,988 | A * | 12/1985 | Kisling et al. | 416/220 R |
| 4,576,547 | A | 3/1986 | Weiner et al. | |
| 4,582,467 | A | 4/1986 | Kisling | |
| 4,645,416 | A | 2/1987 | Weiner | |
| 4,664,599 | A | 5/1987 | Robbins et al. | |
| 4,669,959 | A | 6/1987 | Kalogeros | |
| 4,674,955 | A * | 6/1987 | Howe et al. | 416/95 |
| 4,701,105 | A * | 10/1987 | Cantor et al. | 416/95 |
| 4,820,116 | A | 4/1989 | Hovan et al. | |
| 4,822,244 | A | 4/1989 | Maier et al. | |
| 4,844,694 | A | 7/1989 | Naudet | |
| 4,854,821 | A | 8/1989 | Kernon et al. | |
| 4,880,354 | A | 11/1989 | Teranishi et al. | |
| 4,882,902 | A | 11/1989 | Reigel et al. | |
| 4,890,981 | A | 1/1990 | Corsmeier et al. | |
| 5,173,024 | A | 12/1992 | Mouchel et al. | |
| 5,232,335 | A | 8/1993 | Narayana et al. | |
| 5,275,534 | A | 1/1994 | Cameron et al. | |
| 5,472,313 | A * | 12/1995 | Quinones et al. | 415/115 |

(Continued)

FOREIGN PATENT DOCUMENTS

| | | |
|---|---|---|
| CA | 1040535 | 10/1978 |
| EP | 0222679 | 5/1987 |

(Continued)

*Primary Examiner* — Igor Kershteyn
(74) *Attorney, Agent, or Firm* — Carlson, Gaskey & Olds, P.C.

(57) ABSTRACT

A rotor disk assembly for a gas turbine engine includes a rotor disk with a circumferentially intermittent slot structure that extends radially outward relative to an axis of rotation. A heat shield has a multiple of radial tabs engageable with the circumferentially intermittent slot structure to provide axial retention of the cover plate to the rotor disk.

19 Claims, 6 Drawing Sheets

(56) References Cited

U.S. PATENT DOCUMENTS

| | | | |
|---|---|---|---|
| 5,695,319 | A | 12/1997 | Matsumoto et al. |
| 5,816,776 | A | 10/1998 | Chambon et al. |
| 5,862,666 | A | 1/1999 | Liu |
| 5,954,477 | A | 9/1999 | Balsdon |
| 6,035,627 | A | 3/2000 | Liu |
| 6,053,697 | A | 4/2000 | Pickarski et al. |
| 6,077,035 | A | 6/2000 | Walters et al. |
| 6,106,234 | A | 8/2000 | Gabbitas |
| 6,224,329 | B1 | 5/2001 | North |
| 6,227,801 | B1 | 5/2001 | Liu |
| 6,283,712 | B1 | 9/2001 | Dziech et al. |
| 6,334,755 | B1 | 1/2002 | Coudray et al. |
| 6,370,866 | B2 | 4/2002 | Marushima et al. |
| 6,375,429 | B1 | 4/2002 | Halila et al. |
| 6,393,829 | B2 | 5/2002 | Marushima et al. |
| 6,568,191 | B2 | 5/2003 | Marushima et al. |
| 6,575,703 | B2 | 6/2003 | Simeone et al. |
| 6,648,592 | B2 | 11/2003 | Escure et al. |
| 6,735,957 | B2 | 5/2004 | Marushima et al. |
| 6,749,400 | B2 | 6/2004 | Dougherty et al. |
| 6,877,950 | B2 | 4/2005 | Liu |
| 6,899,520 | B2 | 5/2005 | Habedank et al. |
| 6,910,852 | B2 | 6/2005 | Simeone et al. |
| 6,960,060 | B2 | 11/2005 | Lee |
| 6,981,841 | B2 | 1/2006 | Krammer et al. |
| 7,028,486 | B2 | 4/2006 | Marushima et al. |
| 7,028,487 | B2 | 4/2006 | Marushima et al. |
| 7,040,866 | B2 | 5/2006 | Gagner |
| 7,159,402 | B2 | 1/2007 | Hein et al. |
| 7,179,049 | B2 | 2/2007 | Glasspoole |
| 7,229,247 | B2 | 6/2007 | Durocher et al. |
| 7,229,249 | B2 | 6/2007 | Durocher et al. |
| 7,319,206 | B2 | 1/2008 | Thommes |
| 7,322,101 | B2 | 1/2008 | Suciu et al. |
| 7,331,763 | B2 | 2/2008 | Higgins et al. |
| 7,344,354 | B2 | 3/2008 | Lammas et al. |
| 7,390,167 | B1 | 6/2008 | Bouiller et al. |
| 7,458,774 | B2 | 12/2008 | Albrecht, Jr. et al. |
| 7,520,718 | B2 | 4/2009 | Engle |
| 7,578,656 | B2 | 8/2009 | Higgins et al. |
| 7,743,613 | B2 | 6/2010 | Lee et al. |
| 2010/0040479 | A1 | 2/2010 | Spangler et al. |
| 2010/0089019 | A1 | 4/2010 | Knight et al. |
| 2010/0092278 | A1 | 4/2010 | Major et al. |
| 2010/0124495 | A1 | 5/2010 | Bifulco |
| 2010/0150711 | A1 | 6/2010 | Beaulieu |

FOREIGN PATENT DOCUMENTS

| | | |
|---|---|---|
| EP | 0463995 | 6/1991 |
| FR | 966804 | 10/1950 |
| GB | 2042652 | 9/1980 |

* cited by examiner

MULTI-FUNCTION HEAT SHIELD FOR A GAS TURBINE ENGINE

BACKGROUND

The present disclosure relates to gas turbine engines, and in particular, to a heat shield therefor.

In a gas turbine engine, rotor cavities are often separated by full hoop shells. Significant temperature difference may occur between steady state and transient operational conditions in adjacent rotor cavities. Where components which form the adjacent rotor cavities are mated by a radial interference fit, such significant temperature differences may complicate the initial radial interference fit requirements for assembly and disassembly.

SUMMARY

A rotor disk assembly for a gas turbine engine according to an exemplary aspect of the present disclosure includes a rotor disk defined about an axis of rotation. The rotor disk has a circumferentially intermittent slot structure that extends radially outward relative to the axis of rotation. A heat shield has a multiple of radial tabs which extend radially inward relative to the axis of rotation. The multiple of radial tabs are engageable with the circumferentially intermittent slot structure to provide axial retention of the cover plate to the rotor disk.

A gas turbine engine according to an exemplary aspect of the present disclosure includes a rotor disk defined about an axis of rotation. The rotor disk has a circumferentially intermittent slot structure and a flange that extends radially outward from a cylindrical extension relative to the axis of rotation. A front cover plate defined about the axis of rotation, the front cover plate having a stop which extends radially inward from a cylindrical extension of the front cover plate relative to the axis of rotation. The front cover plate is located adjacent to the rotor disk such that the stop is adjacent to the flange. A heat shield is defined about the axis of rotation, the heat shield has a multiple of radial tabs which extend radially inward relative to the axis of rotation. The heat shield is located adjacent to the front cover plate such that the multiple of radial tabs engage with the circumferentially intermittent slot structure to provide axial retention of the front cover plate to the rotor disk.

A method to assemble a rotor disk assembly according to an exemplary aspect of the present disclosure includes locating a cover plate adjacent to a rotor disk along an axis of rotation. Axially locating a heat shield having a multiple of radial tabs which extend radially inward relative to the axis of rotation, the multiple of radial tabs axially aligned with openings defined by a circumferentially intermittent slot structure on the rotor disk. Rotating the heat shield to radially align the multiple of radial tabs with the circumferentially intermittent slot structure to axially retain the cover plate to the rotor disk.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
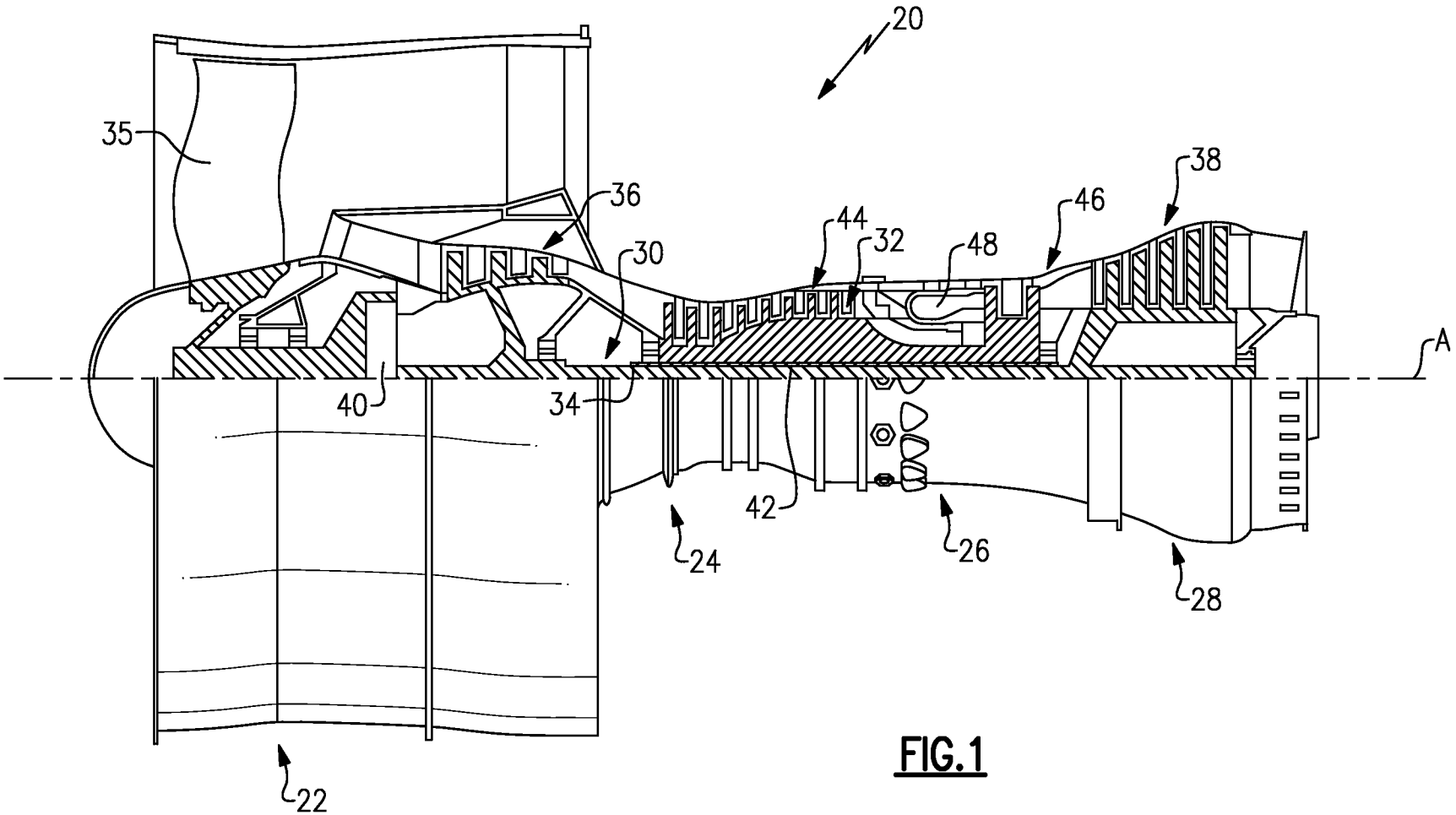
FIG. 1 is a schematic cross-section of a gas turbine engine.

FIG. 1 schematically illustrates a gas turbine engine 20. The gas turbine engine 20 is disclosed herein as two-spool turbofan that generally incorporates a fan section 22, a compressor section 24, a combustor section 26 and a turbine section 28 along an engine central longitudinal axis A. Alternative engines might include an augmentor section (not shown) among other systems or features. The fan section 22 drives air along a bypass flowpath while the compressor section 24 receives air from the fan section 22 along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines.

The engine 20 generally includes a low speed spool 30 and a high speed spool 32 mounted upon a multiple of bearing systems for rotation about the engine central longitudinal axis A relative to an engine stationary structure. The low speed spool 30 generally includes an inner shaft 34 that interconnects a fan 35, a low pressure compressor 36 and a low pressure turbine 38. The inner shaft 34 may drive the fan 35 either directly or through a geared architecture 40 to drive the fan 35 at a lower speed than the low speed spool 30. The high speed spool 32 includes an outer shaft 42 that interconnects a high pressure compressor 44 and high pressure turbine 46. A combustor 48 is arranged between the high pressure compressor 44 and the high pressure turbine 46.

Core airflow is compressed by the low pressure compressor 36 then the high pressure compressor 44, mixed with the fuel in the combustor 48 then expanded over the high pressure turbine 46 and low pressure turbine 38. The turbines 38, 46 rotationally drive the respective low speed spool 30 and high speed spool 32 in response to the expansion.

Figure 2:
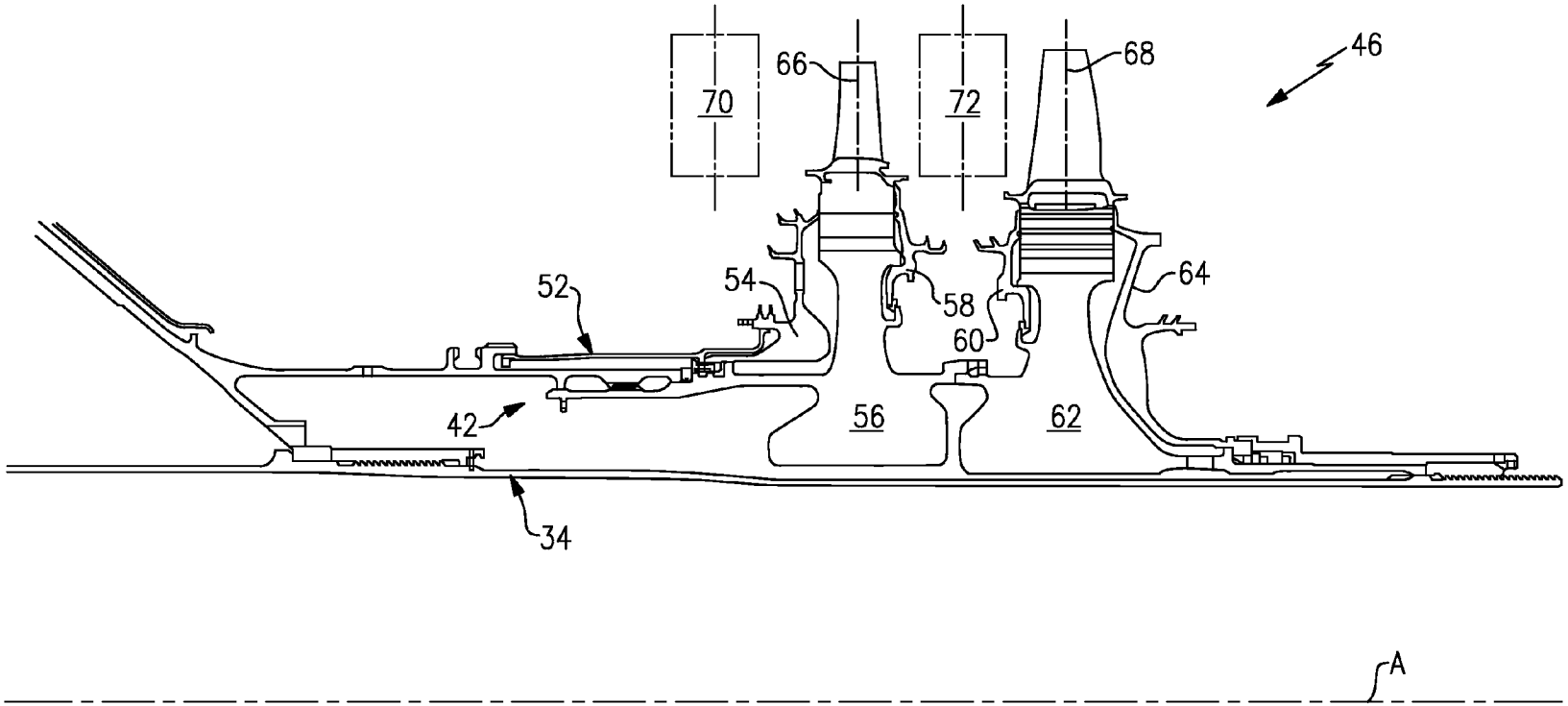
FIG. 2 is a sectional view of a high pressure turbine.

With reference to FIG. 2, the high speed spool 32 generally includes a heat shield 52, a first front cover plate 54, a first turbine rotor disk 56, a first rear cover plate 58, a second front cover plate 60, a second turbine rotor disk 62, and a rear cover plate 64. Although two rotor disk assemblies are illustrated in the disclosed non-limiting embodiment, it should be understood that any number of rotor disk assemblies will benefit herefrom. A tie-shaft arrangement may, in one non-limiting embodiment, utilize the outer shaft 42 or a portion thereof as a center tension tie-shaft to axially preload and compress at least the first turbine rotor disk 56 and the second turbine rotor disk 62 therebetween in compression.

The components may be assembled to the outer shaft 42 from fore-to-aft (or aft-to-fore, depending upon configuration) and then compressed through installation of a locking element (not shown) to hold the stack in a longitudinal precompressed state to define the high speed spool 32. The longitudinal precompressed state maintains axial engagement between the components such that the axial preload maintains the high pressure turbine 46 as a single rotary unit. It should be understood that other configurations such as an array of circumferentially-spaced tie rods extending through web portions of the rotor disks, sleeve like spacers or other interference and/or keying arrangements may alternatively or additionally be utilized to provide the tie shaft arrangement.

Each of the rotor disks 56, 62 are defined about the axis of rotation A to support a respective plurality of turbine blades 66, 68 circumferentially disposed around a periphery thereof. The plurality of blades 66, 68 define a portion of a stage downstream of a respective turbine vane structure 70, 72 within the high pressure turbine 46. The cover plates 54, 58, 60, 64 operate as air seals for airflow into the respective rotor disks 56, 62. The cover plates 54, 58, 60, 64 also operate to segregate air in compartments through engagement with fixed structure such as the turbine vane structure 70, 72.

Figure 3:
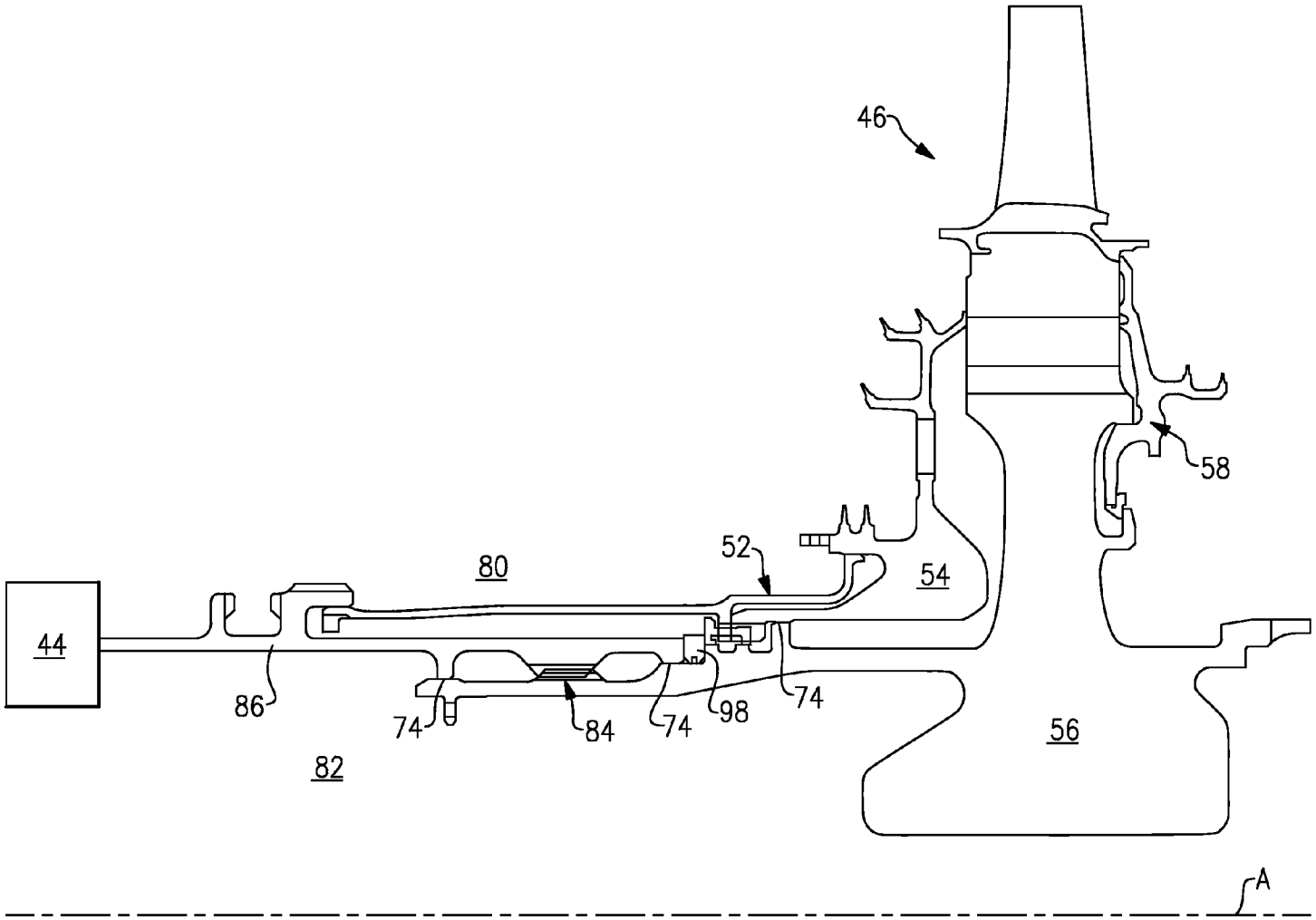
FIG. 3 is an enlarged sectional view of the high pressure turbine illustrating a heat shield and axial retention of a cover plate provided thereby.

With reference to FIG. 3, the heat shield 52 in the disclosed non-limiting embodiment may be a full hoop heat shield that separates a relatively hotter outer diameter cavity 80 from a relatively cooler inner diameter cavity 82 and spans an interface 84 between the high pressure turbine 46 and the high pressure compressor 44 (illustrated schematically). The interface 84 may be a splined interface which facilitates assembly and disassembly of the high pressure turbine 46 and the high pressure compressor 44 in separate engine modules. The heat shield 52 provides a thermal insulator between the relatively hotter outer diameter cavity 80 from the relatively cooler inner diameter cavity 82 to slow the transient thermal response and thereby allow a much smaller initial radial interference fit at contact points 74 between the high pressure turbine 46 and the high pressure compressor 44.

The mating components between the high pressure turbine 46 and the high pressure compressor 44 in the disclosed non-limiting embodiment are the first turbine rotor disk 56 and the high pressure compressor rear hub 86. Axial retention of the first front cover plate 54 is thereby provided by the heat shield 52 and the first turbine rotor disk 56.

Figure 4:
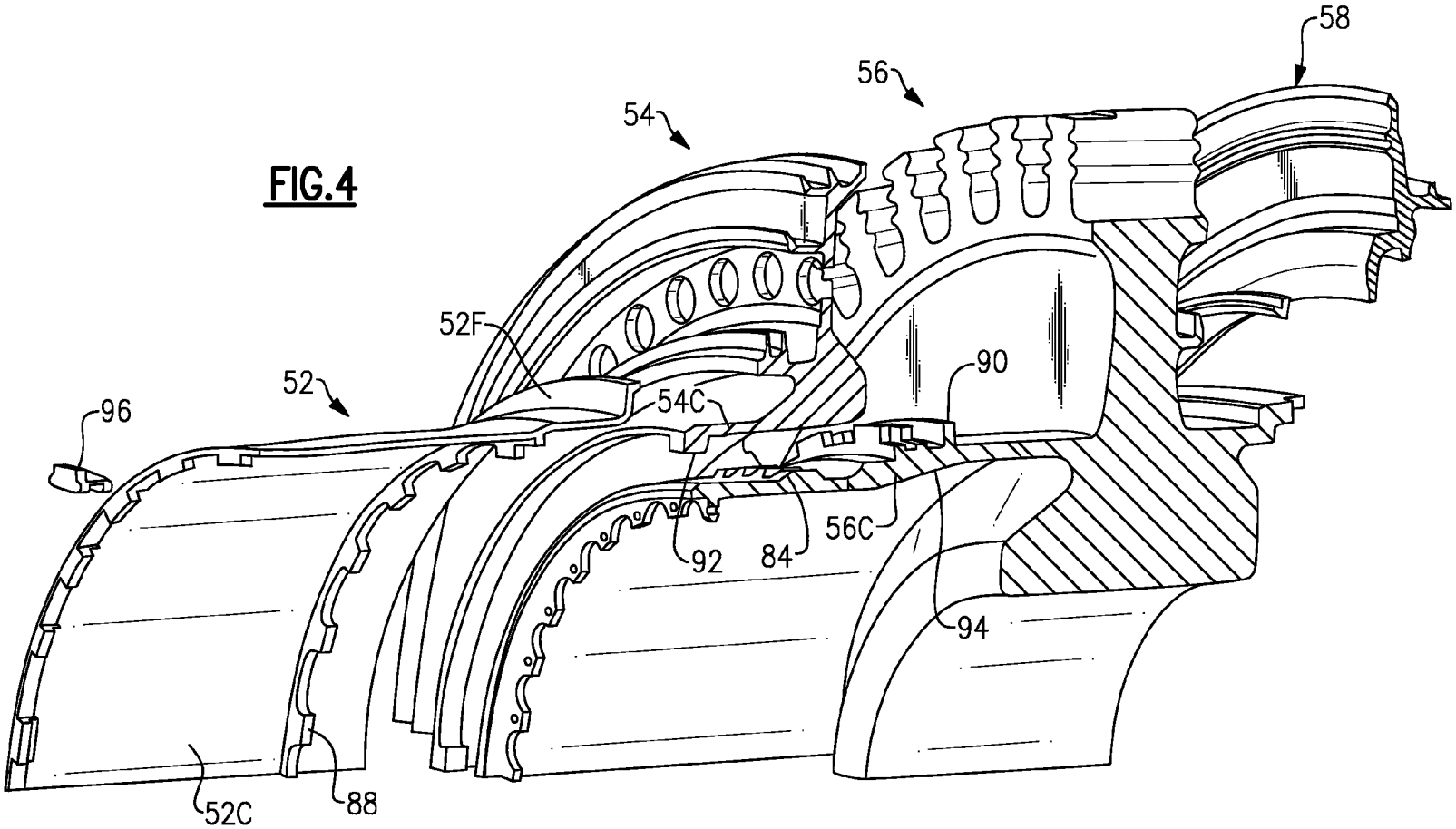
FIG. 4 is an exploded perspective view of a rotor disk assembly.
Figure 5:
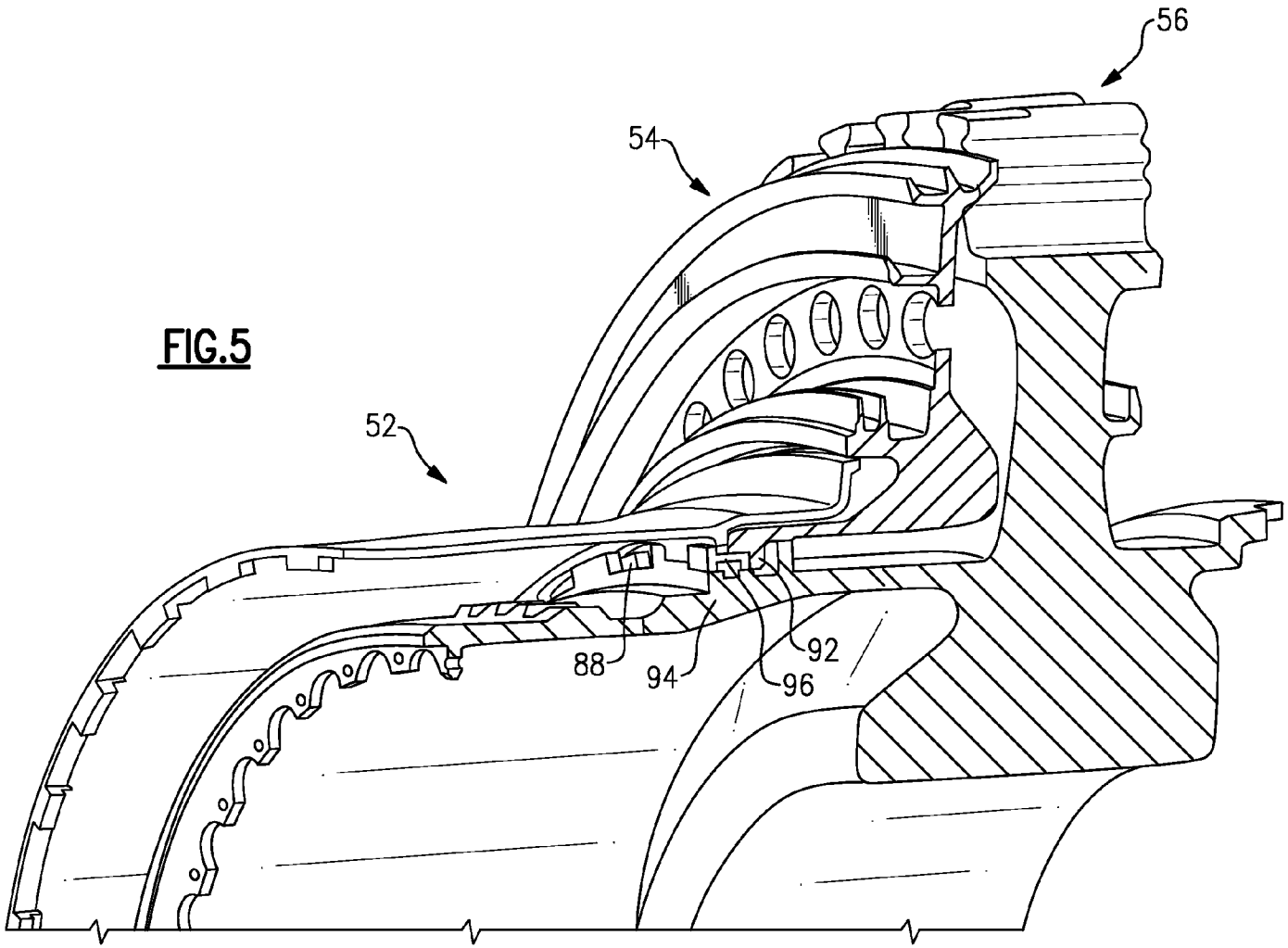
FIG. 5 is a perspective view of the rotor disk assembly.

With reference to FIG. 4, the heat shield 52 includes a series of radial tabs 88 which extend radially inward from a cylindrical extension 52C of the heat shield 52. The heat shield 52 also includes a radially outward flange 52F at an aft end section thereof to abut and provide a radially outward bias to the first front cover plate 54 (FIG. 5). The series of radial tabs 88 extend in a generally opposite direction relative to the radially outward flange 52F. The series of radial tabs 88 function as a bayonet lock to provide axial retention for the first front cover plate 54 to the first turbine rotor disk 56 (FIG. 5).

A flange 90 extends radially outward from a cylindrical extension 56C of the first turbine rotor disk 56 to be adjacent to a cover plate stop 92 which extends radially inward from a cylindrical extension 54C of the first front cover plate 54. A circumferentially intermittent slot structure 94 extends radially outward from the cylindrical extension 56C of the first turbine rotor disk 56 just upstream, i.e., axially forward, of the flange 90 to receive the radial tabs 88. Although a particular circumferentially intermittent slot structure 94 which is defined by circumferentially intermittent pairs of axially separated and radially extended tabs is illustrated in the disclosed non-limiting embodiment, it should be understood that various types of lugs may alternatively be utilized.

Figure 6:
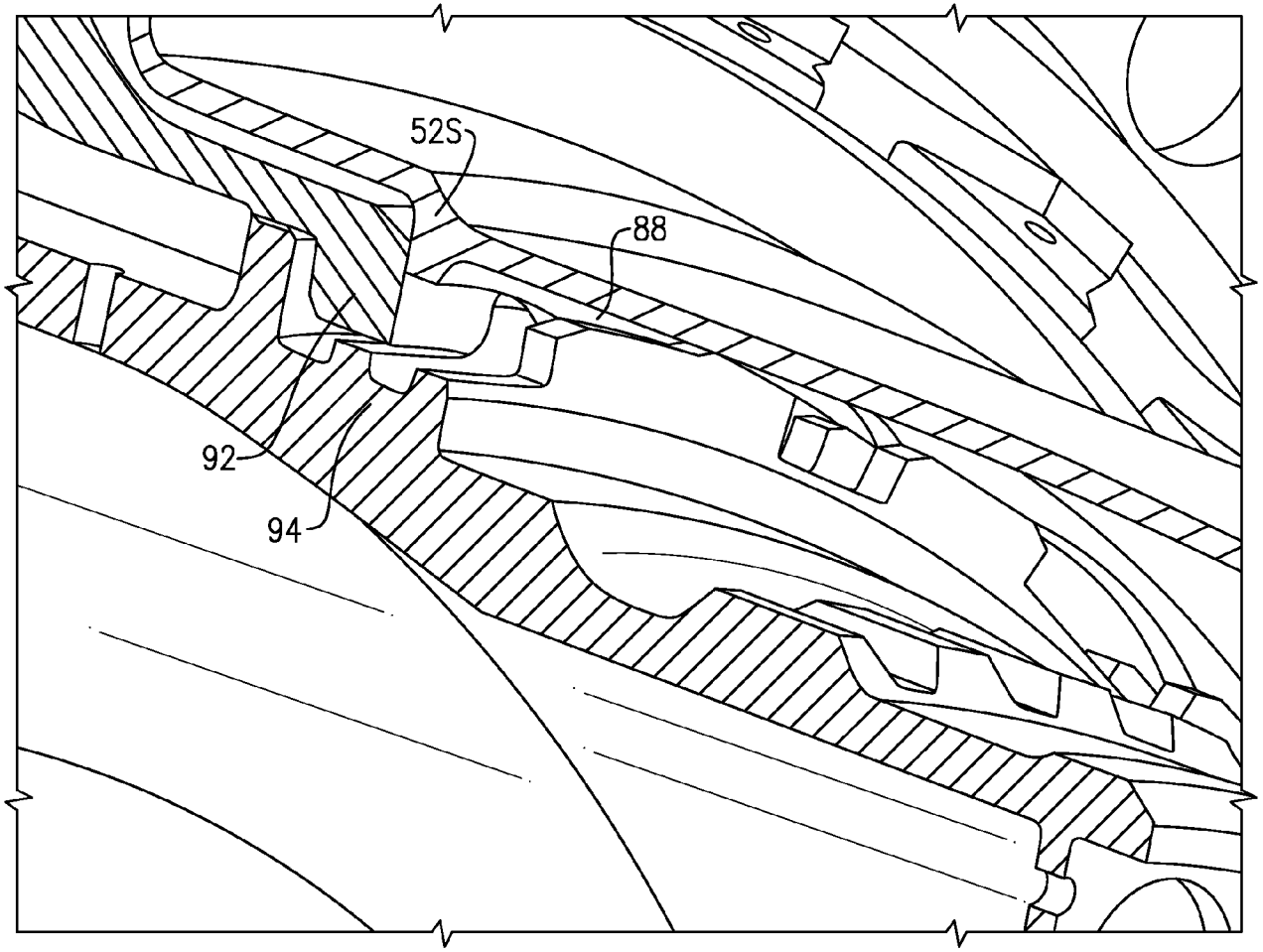
FIG. 6 is an expanded view of an interface between a heat shield, cover plate, and rotor disk of the rotor disk assembly.

In a method of assembly, the first front cover plate 54 is located adjacent to the first turbine rotor disk 56 such that the cover plate stop 92 is adjacent to the flange 90 and may be at least partially axially retained by the radial tabs 88. A step surface 52S in the cylindrical extension 52C (FIG. 6) may be formed adjacent to the radial tabs 88 to further abut and axially retain the cover plate stop 92. The cover plate stop 92 may also be radially engaged with the openings formed by the circumferentially intermittent slot structure 94 to provide an anti-rotation interface.

The heat shield 52 is located axially adjacent to the first front cover plate 54 such that the radial tabs 88 pass through openings formed by the circumferentially intermittent slot structure 94. The heat shield 52 (also shown in FIG. 6) is then rotated such that the radial tabs 88 are aligned with the circumferentially intermittent slot structure 94. That is, the heat shield 52 operates as an axial retention device for the first front cover plate 54. One or more locks 96 are then inserted in the openings formed by the circumferentially intermittent slot structure 94 to circumferentially lock the heat shield 52 to the first turbine rotor disk 56 and prevent rotation during operation thereof.

An annular spacer 98 (FIG. 3) may be located between the circumferentially intermittent slot structure 94 and the high pressure compressor rear hub 86. The annular spacer 98 extends radially above the circumferentially intermittent slot structure 94 to axially trap the locks 96 as well as define the desired axial distance between the high pressure compressor rear hub 86 relative to the cylindrical extension 56C of the first turbine rotor disk 56.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present invention.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the invention may be practiced other than as specifically described. For that reason the appended claims should be studied to determine true scope and content.

What is claimed:

1. A rotor disk assembly for a gas turbine engine comprising:

a rotor disk defined about an axis of rotation, said rotor disk having a circumferentially intermittent slot structure that extends radially outward relative to said axis of rotation;

a cover plate defined about said axis of rotation, said cover plate located adjacent to said rotor disk; and a heat shield defined about said axis of rotation, said heat shield having a multiple of radial tabs which extend radially inward relative to said axis of rotation, said multiple of radial tabs engageable with said circumferentially intermittent slot structure to provide axial retention of said cover plate to said rotor disk.

2. The rotor disk assembly as recited in claim 1, wherein said circumferentially intermittent slot structure is upstream of a flange, said cover plate having a stop which extends radially inward from a cylindrical extension relative to said axis of rotation, said cover plate located adjacent to said rotor disk such that said stop is adjacent to said flange.

3. The rotor disk assembly as recited in claim 2, wherein said stop is engaged with openings formed by said circumferentially intermittent slot structure to provide an anti-rotation interface.

4. The rotor disk assembly as recited in claim 1, wherein said cover plate is a front cover plate.

5. The rotor disk assembly as recited in claim 1, wherein said circumferentially intermittent slot structure extends radially outward from a cylindrical extension from said rotor disk.

6. The rotor disk assembly as recited in claim 1, wherein rotor disk is a turbine rotor disk.

7. The rotor disk assembly as recited in claim 1, wherein said heat shield is located axially forward of said cover plate.

8. The rotor disk assembly as recited in claim 1, wherein said heat shield includes a radially outward flange.

9. The rotor disk assembly as recited in claim 1, further comprising a lock engaged with at least one opening formed by said circumferentially intermittent slot structure to provide an anti-rotation interface for said heat shield.

10. A gas turbine engine comprising:

a rotor disk defined about an axis of rotation, said rotor disk having a circumferentially intermittent slot structure and a flange that extends radially outward from a cylindrical extension relative to said axis of rotation;

a front cover plate defined about said axis of rotation, said front cover plate having a stop which extends radially inward from a cylindrical extension of said front cover plate relative to said axis of rotation, said front cover plate located adjacent to said rotor disk such that said stop is adjacent to said flange; and a heat shield defined about said axis of rotation, said heat shield having a multiple of radial tabs which extend radially inward relative to said axis of rotation, said heat shield located adjacent to said front cover plate such that said multiple of radial tabs engage with said circumferentially intermittent slot structure to provide axial retention of said front cover plate to said rotor disk.

11. The gas turbine engine as recited in claim 10, wherein said heat shield separates relatively hotter outer diameter cavity from a relatively cooler inner diameter cavity.

12. The gas turbine engine as recited in claim 10, wherein said heat shield spans an interface.

13. The gas turbine engine as recited in claim 12, wherein said interface is a splined interface between a high pressure turbine and a high pressure compressor.

14. A method to assemble a rotor disk assembly comprising:

locating a cover plate adjacent to a rotor disk along an axis of rotation;

axially locating a heat shield having a multiple of radial tabs which extend radially inward relative to the axis of rotation, the multiple of radial tabs axially aligned with openings defined by a circumferentially intermittent slot structure on the rotor disk; and rotating the heat shield to radially align the multiple of radial tabs with the circumferentially intermittent slot structure to axially retain the cover plate to the rotor disk.

15. A method as recited in claim 14, further comprising:

engaging a lock with at least one opening formed by the circumferentially intermittent slot structure to provide an anti-rotation interface for the heat shield.

16. A method as recited in claim 14, further comprising:

separating a relatively hotter outer diameter cavity from a relatively cooler inner diameter cavity with the heat shield.

17. A method as recited in claim 14, further comprising:

spanning an interface with the heat shield.

18. A method as recited in claim 14, further comprising:

spanning a splined interface between a high pressure turbine and a high pressure compressor.

19. A method as recited in claim 14, wherein rotating the heat shield to radially align the multiple of radial tabs with the circumferentially intermittent slot structure reduces an initial radial interference fit at contact points between a high pressure turbine and a high pressure compressor radial interference fit.

* * * * *